US009925682B2

(12) United States Patent
Matsuyama

(10) Patent No.: US 9,925,682 B2
(45) Date of Patent: Mar. 27, 2018

(54) CUTTING APPARATUS

(71) Applicant: DISCO CORPORATION, Tokyo (JP)

(72) Inventor: Toshifumi Matsuyama, Tokyo (JP)

(73) Assignee: Disco Corporation, Tokyo (JP)

( * ) Notice: Subject to any disclaimer, the term of this patent is extended or adjusted under 35 U.S.C. 154(b) by 0 days.

(21) Appl. No.: 15/151,721

(22) Filed: May 11, 2016

(65) Prior Publication Data

US 2016/0339596 A1 Nov. 24, 2016

(30) Foreign Application Priority Data

May 20, 2015 (JP) ..... 2015-102531

(51) Int. Cl.

| | |
|---|---|
| ***B26D 7/01*** | (2006.01) |
| ***B26D 3/06*** | (2006.01) |
| ***B26D 7/08*** | (2006.01) |
| ***B26D 7/12*** | (2006.01) |

(52) U.S. Cl.

CPC ..... *B26D 7/018* (2013.01); *B26D 3/065* (2013.01); *B26D 7/088* (2013.01); *B26D 7/12* (2013.01)

(58) Field of Classification Search

CPC ..... B26D 7/018; B26D 7/088; B26D 7/12; B26D 3/065

USPC ..... 83/98, 99, 100, 875, 878

See application file for complete search history.

(56) References Cited

U.S. PATENT DOCUMENTS 4,527,346 A * 7/1985 Schwartzott ..... A41H 43/005 112/DIG. 2
5,197,160 A * 3/1993 Smith ..... A47L 5/14 15/306.1
5,699,707 A * 12/1997 Campbell, Jr. ..... B26D 7/018 198/689.1
2008/0028904 A1* 2/2008 Arikita ..... B26D 7/018 83/24
2009/0272403 A1* 11/2009 Yamamoto ..... B26D 7/088 134/6
2010/0313722 A1* 12/2010 Fastert ..... B26D 7/018 83/24
2011/0000350 A1* 1/2011 Zorzolo ..... C14B 5/00 83/76.6

FOREIGN PATENT DOCUMENTS

| | | |
|---|---|---|
| JP | 2011-009324 | 1/2011 |
| JP | 2011-258689 | 12/2011 |
| JP | 2013-022713 | 2/2013 |

* cited by examiner

*Primary Examiner* — Omar Flores Sanchez
(74) *Attorney, Agent, or Firm* — Greer Burns & Crain Ltd.

(57) ABSTRACT

A cutting apparatus includes: a first piping for communication of a suction surface with a first suction source; a branched pipe by which the first piping is branched to an upper-side outlet for passage toward the first suction source and a lower-side outlet for passage toward a second suction source; and a second piping for communication of the lower-side outlet with the second suction source. The cross-sectional area of the branched pipe is set greater than the cross-sectional area of the first piping, such that the flow velocity of a fluid upon transfer of the fluid from the first piping into the branched pipe is lowered. Liquid goes down toward the lower-side outlet of the branched pipe, whereby a gas and the liquid are separated from each other, and the gas is sucked by the first suction source, whereas the liquid is sucked by the second suction source.

1 Claim, 4 Drawing Sheets

CUTTING APPARATUS

BACKGROUND OF THE INVENTION

Field of the Invention

The present invention relates to a cutting apparatus wherein dressing of a cutting blade is conducted by use of a dresser board.

Description of the Related Art

In a cutting apparatus, a cutting blade is periodically dressed during a cutting process, to maintain a cutting force of the cutting blade. The dressing of the cutting blade is conducted by causing the cutting blade to cut into a surface of a dresser board provided as a workpiece that is suction held on a holding table (see, for example, Japanese Patent Laid-Open No. 2013-22713). When cut grooves are formed in the surface of the dresser board by the cutting blade, the stress balance between the face side and the back side of the dresser board gets upset, and a one-side surface (upper surface) of the dresser board warps into a concave shape. Due to the warping of the dresser board, a gap is formed between the upper surface of the holding table and the lower surface of the dresser board, and cutting water penetrates via the gap, lowering the suction force.

In view of this problem, a configuration wherein warping of the dresser board attendant on the formation of the cut grooves is restricted by the holding table in such a manner that a gap is not formed between the upper surface of the holding table and the lower surface of the dresser board has been investigated. As a configuration for restraining the warping of the dresser board, a configuration wherein both ends of the dresser board are mechanically held down on the holding table to thereby restrict the warping of the dresser board has been investigated (see, for example, Japanese Patent Laid-Open No. 2011-258689). Similarly, a configuration has been investigated wherein one end of the dresser board is mechanically held down on the holding table and the other end side of the dresser board is strongly suction held to thereby restrict the warping of the dresser board (see, for example, Japanese Patent No. 5350908).

SUMMARY OF THE INVENTION

However, the configuration wherein the warping of the dresser board is mechanically restricted as described in Japanese Patent Laid-Open No. 2013-22713 and Japanese Patent Laid-Open No. 2011-258689 has had a drawback of complicating the structure of the holding table. In order to restrain the warping of the dresser board, it may be contemplated to use a strong-powered suction pump. In this case, however, there arises a problem that large-type equipment is needed. In addition, in order to maintain a suction force without using any large suction pump, a configuration may be contemplated wherein the cutting water penetrating through the gap is accumulated in a tank and is periodically discharged. In such a case, normally, it is detected by a sensor or the like whether the cutting water is being sucked, and the cutting water is discharged from the tank by changing over a valve. However, there is a problem that the suction force is lowered in relation to the slight timing of the change-over of the valve.

Accordingly, it is an object of the present invention to provide a cutting apparatus wherein a suction force applied to a workpiece on a holding table can be maintained even when the workpiece is warped on the holding table.

In accordance with an aspect of the present invention, there is provided a cutting apparatus including: a holding table having a suction surface for suction holding a plate-shaped workpiece; cutting means for cutting the workpiece suction held by the holding table by a cutting blade while supplying cutting water to the workpiece; and suction force maintaining means for maintaining a suction force of the holding table for suction holding the workpiece, wherein the suction force maintaining means includes: a first piping for communication of the suction surface with a first suction source; a branched pipe by which the first piping is branched in its course to an upper-side outlet for passage toward the first suction source and a lower-side outlet for passage toward a second suction source; and a second piping for communication of the lower-side outlet with the second suction source, the first suction source and the second suction source are each an ejector, which includes: a supply port supplying air; a discharge port discharging the air; and a suction port communicating with a negative pressure generating part generating a negative pressure by causing the air to flow from the supply port to the discharge port, a cross-sectional area of the branched pipe is set greater than a cross-sectional area of the first piping, such that flow velocity of a fluid upon transfer of the fluid from the first piping into the branched pipe is lowered due to a difference in cross-sectional area, a branched shape of the branched pipe ensures that a gas sucked in from the suction surface goes toward the upper-side outlet of the branched pipe, whereas a liquid sucked in from the suction surface goes down toward the lower-side outlet of the branched pipe, whereby the gas and the liquid are separated from each other, and the separated liquid is sucked by the second suction source and discharged from the second piping, whereby the suction force applied at the suction surface by the first suction source is maintained.

According to this configuration, the cross-sectional area of the branched pipe is set larger than the cross-sectional area of the first piping to generate a difference in cross-sectional area, whereby the flow velocities of a gas and a liquid sucked in from the suction surface of the holding table are lowered upon transfer of the fluids from the first piping into the branched pipe. Due to the lowering in the flow velocities, the gas goes toward the upper-side outlet of the branched pipe, whereas the liquid goes down toward the lower-side outlet of the branched pipe by its own weight, so that the gas and the liquid are appropriately separated from each other. The liquid thus separated in the branched pipe is sucked into the second suction source, whereby the suction force applied by the first suction source for suction holding the workpiece onto the holding table is maintained even in the case where the gas and the liquid are sucked in from the suction surface of the holding table. Therefore, it is unnecessary to use large suction equipment such as a pump having a strong suction force, and ejectors having comparatively weak suction forces can be used as the first suction source and the second suction source. Consequently, the suction equipment for the workpiece can be reduced in size.

According to the present invention, by setting the cross-sectional area of the branched pipe to be greater than the cross-sectional area of the first piping to effect appropriate separation between the gas and the liquid, the suction force applied to the workpiece can be maintained even when the gas and the liquid are sucked in from the suction surface of the holding table.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
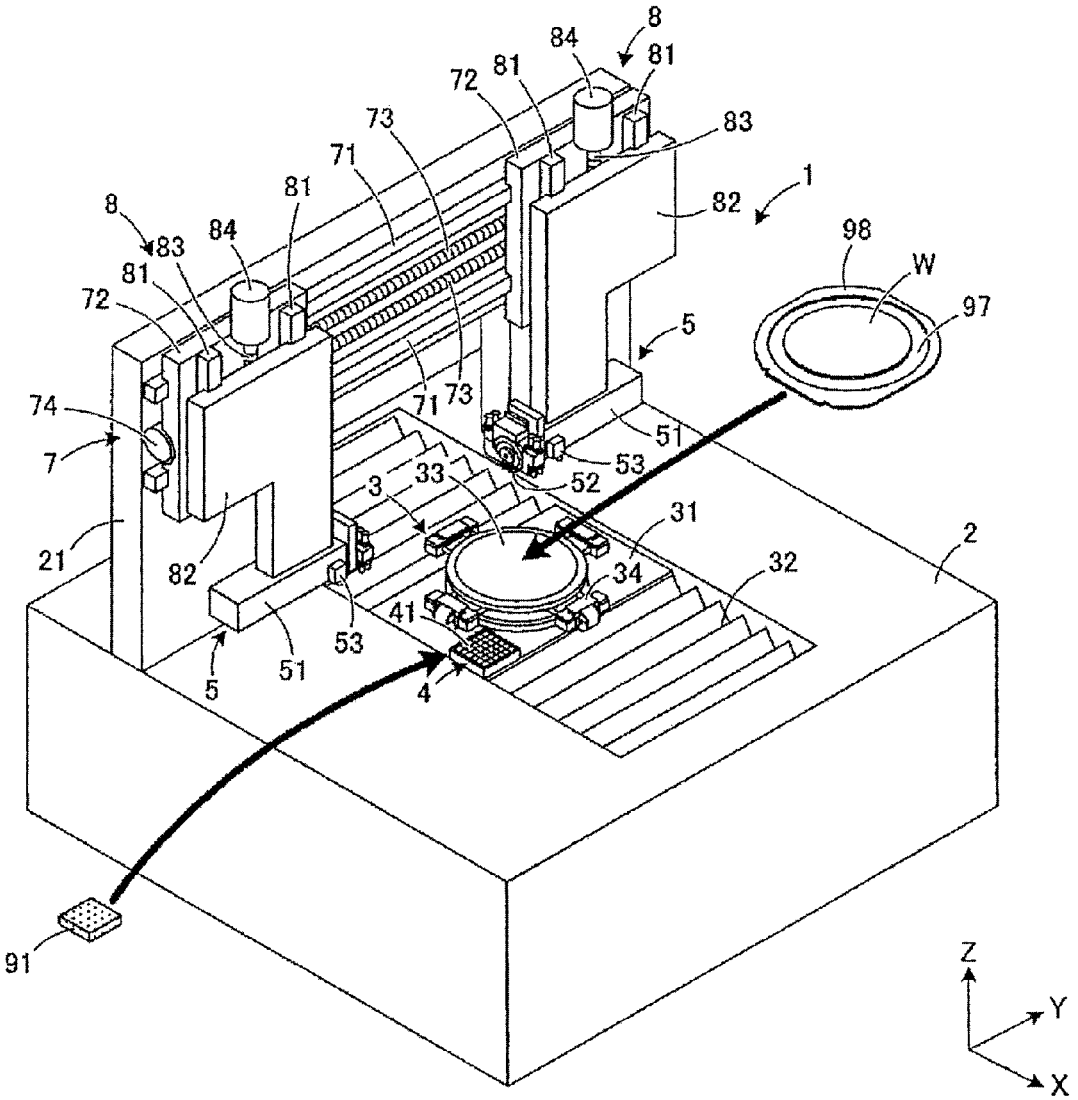
FIG. 1 is a perspective view of a cutting apparatus according to an embodiment of the present invention.

A cutting apparatus according to an embodiment of the present invention will be described below referring to the attached drawings. FIG. 1 is a perspective view of a cutting apparatus according to an embodiment of the present invention. Note that the cutting apparatus according to the present embodiment is not limited to the configuration illustrated in FIG. 1. While a cutting apparatus provided with a pair of cutting blades is shown as an example here, this configuration is not restrictive. The present invention is applicable to any cutting apparatus wherein a cutting blade is dressed by use of a dresser board as a workpiece.

As illustrated in FIG. 1, the cutting apparatus 1 is configured to cut a work W by moving a pair of cutting means 5 having cutting blades 52 and a chuck table 3 holding the work W thereon relative to each other. The work W is fed in to the cutting apparatus 1 in the state of being supported on a ring frame 98 through a dicing tape 97. Note that the work W may be a semiconductor wafer wherein semiconductor devices are formed on a semiconductor substrate formed of silicon, gallium arsenic or the like, or may be an optical device wafer wherein optical devices are formed on an inorganic material substrate based on ceramic, glass or sapphire. Note that the work W may be a semiconductor substrate or inorganic material substrate before formation of devices thereon.

A central area of an upper surface of a base 2 of the cutting apparatus 1 is opened in a rectangular shape such as to extend in an X-axis direction, and a movable plate 31 and a waterproof cover 32 are provided in such a manner as to cover the opening. On the movable plate 31 is provided the chuck table 3 capable of being rotated about a Z-axis. Under the waterproof cover 32 and the movable plate 31 is provided machining feeding means (not shown) by which the chuck table 3 is moved in the X-axis direction. The chuck table 3 is provided at an upper surface thereof with a holding surface 33 for holding the work W thereon. In the surroundings of the chuck table 3, there are provided four clamp parts 34 by which the ring frame 98 at the periphery of the work W is clamped and fixed.

In addition, in the vicinity of the chuck table 3 on the movable plate 31, there is provided a holding table 4 having a suction surface 41, and a dresser board 91 as a plate-shaped workpiece is suction held on the suction surface 41. The suction surface 41 of the holding table 4 is formed with a multiplicity of suction grooves and suction holes, and the dresser board 91 is suction held by a negative pressure generated at the suction surface 41. The dresser board 91 is formed by a method wherein abrasive grains based on green carborundum (GC) or white alundum (WA) are bound in a plate shape with a rectangular upper surface by use of a bonding agent such as a resin bond. The cutting blade 52 is dressed by causing the cutting blade 52 to cut into the dresser board 91.

Besides, on the upper side of the base 2, there is provided a gate-formed column part 21 erected in such a manner as to straddle the opening extending in the X-axis direction. The gate-formed column part 21 is provided with indexing feeding means 7 for moving the pair of cutting means 5 in a Y-axis direction, and cutting-in feeding means 8 for moving the pair of cutting means 5 in a Z-axis direction. The indexing feeding means 7 includes a pair of guide rails 71 disposed on a front side of the column part 21 in parallel to the Y-axis direction, and a pair of Y-axis tables 72 which are disposed to be slidable on the pair of guide rails 71 and are driven by motors. Each cutting-in feeding means 8 includes a pair of guide rails 81 disposed on the front side of each Y-axis table 72 in parallel to the Z-axis direction, and a Z-axis table 82 which is disposed to be slidable on the pair of guide rails 81 and is driven by a motor.

At lower portions of the Z-axis table 82, there are provided the cutting means 5 for cutting the work W. In addition, on the back side of the Y-axis tables 72 are formed nut parts (not shown), and ball screws 73 are in screw engagement with these nut parts. Besides, on the back side of the Z-axis tables 82 are formed nut parts (not shown), and ball screws 83 are in screw engagement with these nut parts. Driving motors 74 and 84 are connected respectively to a one-side end portion of each of the ball screws 73 for the Y-axis table 72 and to each of the ball screws 83 for the Z-axis table 82. The ball screws 73 and 83 are rotationally driven by the driving motors 74 and 84, whereby the pair of cutting means 5 are moved along the guide rails 71 and 81 in the Y-axis direction and the Z-axis direction.

The pair of cutting means 5 each have a configuration wherein a cutting blade 52 is rotatably mounted to a tip of a spindle (not shown) projecting from a housing 51. The cutting blade 52 is formed in a circular disk shape by binding diamond abrasive grains with a resin bond, for example. In addition, imaging means 53 for imaging the upper side of the work W is provided on the housing 51 of each cutting means 5, and the cutting blades 52 are aligned in relation to the work W on the basis of images obtained by the imaging means 53. The pair of cutting means 5 each cut the work W by the cutting blade 52 while spraying cutting water to the work W from a cutting nozzle (not shown).

In the cutting apparatus 1 configured as above, the cutting blade 52 is worn starting from its part contributing to the cutting, and the tip of the cutting blade 52 gets out of shape. Therefore, the tip of the cutting blade 52 is periodically dressed by use of the dresser board 91. Dressing of the cutting blade 52 is conducted by a method in which the dresser board 91 suction held on the suction surface 41 of the holding table 4 is cut by the cutting blade 52 rotating at a high speed, while supplying cutting water to the dresser board 91. By this, the cutting blade 52 is dressed, and the tip of the cutting blade 52 having been worn by cutting is conditioned to shape.

In this instance, while minute gaps are formed between the dresser board 91 and the holding table 4 due to the ruggedness of the abrasive grains, only a tiny amount of cutting water penetrates into the minute gaps, and this does not exert any adverse effect on the suction force of the holding table 4. When the dressing is repeated and the dresser board 91 is warped into a concave shape, however, a comparatively large gap is formed between the dresser board 91 and the holding table 4, and the cutting water may be sucked together with a gas, resulting in that the suction force cannot be maintained. As a countermeasure against this problem, a configuration in which warping of the dresser board 91 is restrained to prevent penetration of the liquid into the holding table 4 and to maintain the suction force has been investigated, but this approach would complicate the structure of the holding table 4.

In view of this situation, the present inventor investigated a configuration for maintaining the suction force applied to the dresser board 91 even in a state where the dresser board 91 is warped. In the cutting apparatus 1, a T-shaped branched pipe 61 (see FIG. 2) is provided in the course from the suction surface 41 to a suction source, to branch a suction route into a route for passage of a gas and a route for passage of cutting water, and the gas is sucked by a suction source on one side to hold the dresser board 91, whereas the cutting water is discharged by a suction source on the other side, thereby suppressing a lowering in the suction force. This ensures that the suction force of the holding table 4 can be maintained even when the liquid is sucked in from the holding table 4 together with the gas. Consequently, suction holding of the dresser board 91 onto the holding table 4 can be continued even in a state where the dresser board 91 is warped.

Figure 2:
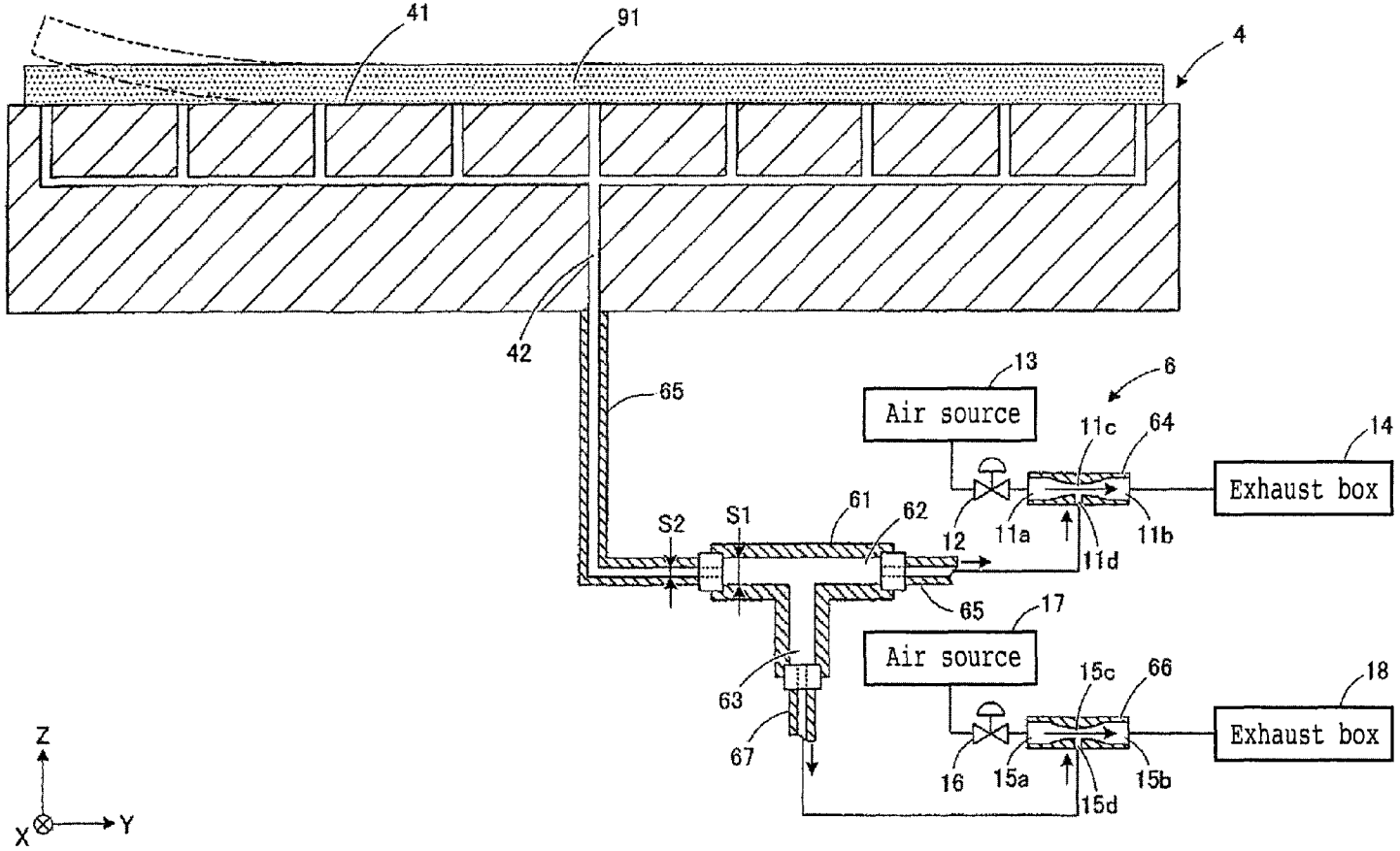
FIG. 2 is a schematic sectional view of a holding table and suction routes according to this embodiment.

Now, the suction routes for the holding table 4 will be described in detail below. FIG. 2 is a schematic diagram of the holding table 4 and the suction routes according to the present embodiment. Note that the holding table 4 and the suction routes according to this embodiment are not limited to the configuration described, and can be modified as required.

Under the holding table 4, there is provided suction force maintaining means 6 for maintaining the suction force applied to the dresser board 91 from the holding table 4. The suction force maintaining means 6 includes a first piping 65 for communication of the suction surface 41 of the holding table 4 with a first suction source 64, the T-shaped branched pipe 61 by which the first piping 65 in its course is branched to an upper-side outlet 62 for passage toward the first suction source 64 and a lower-side outlet 63 for passage toward a second suction source 66, and a second piping 67 for communication of the lower-side outlet 63 with the second suction source 66. In other words, the suction route is branched, by the branched pipe 61 provided in the course of the first piping 65, to the suction route toward the first suction source 64 and the suction route toward the second suction source 66.

The first and second suction sources 64 and 66 are each a so-called ejector, and air supplied from supply ports 11*a* and 15*a* is exhausted from discharge ports 11*b* and 15*b*. Air sources 13 and 17 are connected to the supply ports 11*a* and 15*a* through valves 12 and 16, respectively, and exhaust boxes 14 and 18 are connected to the discharge ports 11*b* and 15*b*, respectively. Intermediate portions between the supply ports 11*a* and 15*a* and the discharge ports 11*b* and 15*b* are reduced in cross-sectional area, thereby forming negative pressure generating parts 11*c* and 15*c* where negative pressures are generated as air is caused to flow from the supply ports 11*a* and 15*a* to the discharge ports 11*b* and 15*b*. Side surfaces of the first and second suction sources 64 and 66 are formed with suction ports 11*d* and 15*d* communicating with the negative pressure generating parts 11*c* and 15*c*.

The suction passage of the first piping 65 communicates with the negative pressure generating part 11*c* of the first suction source 64 via the suction port 11*d*. Air supplied from the air source 13 flows from the supply port 11*a* to the discharge port 11*b*, whereby a fluid is drawn from the suction passage of the first piping 65 via the suction port 11*d*. Similarly, the suction passage of the second piping 67 communicates with the negative pressure generating part 15*c* of the second suction source 66 via the suction port 15*d*. Air supplied from the air source 17 flows from the supply port 15*a* to the discharge port 15*b*, whereby a fluid is drawn from the suction passage of the second piping 67 via the suction port 15*d*. The fluids discharged from the discharge ports 11*b* and 15*b* are subjected to trapping of dust and water mixed in the fluids, by filters in the exhaust boxes 14 and 18.

Thus, the suction passages of the first and second pipings 65 and 67 are provided with the negative pressures, whereby a suction force is generated at the suction surface 41 of the holding table 4. The cross-sectional area S1 of the branched pipe 61 is set greater than the sectional area S2 of the first piping 65. Due to the difference between the cross-sectional area S1 of the branched pipe 61 and the cross-sectional area S2 of the first piping 65, the flow velocity of the fluid sucked from the suction surface 41 of the holding table 4 is lowered as the fluid flows from the first piping 65 into the branched pipe 61. Therefore, even when the dresser board 91 is warped and the fluid containing air (gas) and the cutting water (liquid) is sucked from the suction surface 41 of the holding table 4, the air and the cutting water are appropriately separated from each other by the lowering in the flow velocity of the fluid at the branched pipe 61.

In addition, the branched shape of the branched pipe 61 ensures that the air sucked from the suction surface goes toward the upper-side outlet 62 of the branched pipe 61, whereas the cutting water sucked from the suction surface 41 goes down toward the lower-side outlet 63 of the branched pipe 61 by its own weight. The cutting water separated in the branched pipe 61 is sucked by the second suction source 66 and is discharged through the second piping 67, whereby the suction force applied to the suction surface 41 by the first suction source 64 is maintained. Accordingly, even when the dresser board 91 is warped (the alternate long and two short dashes line in FIG. 2), the suction force applied to the suction surface 41 by the first suction source 64 is prevented from being lowered, so that suction holding of the dresser board 91 onto the holding table 4 can be continued.

Figure 3A:
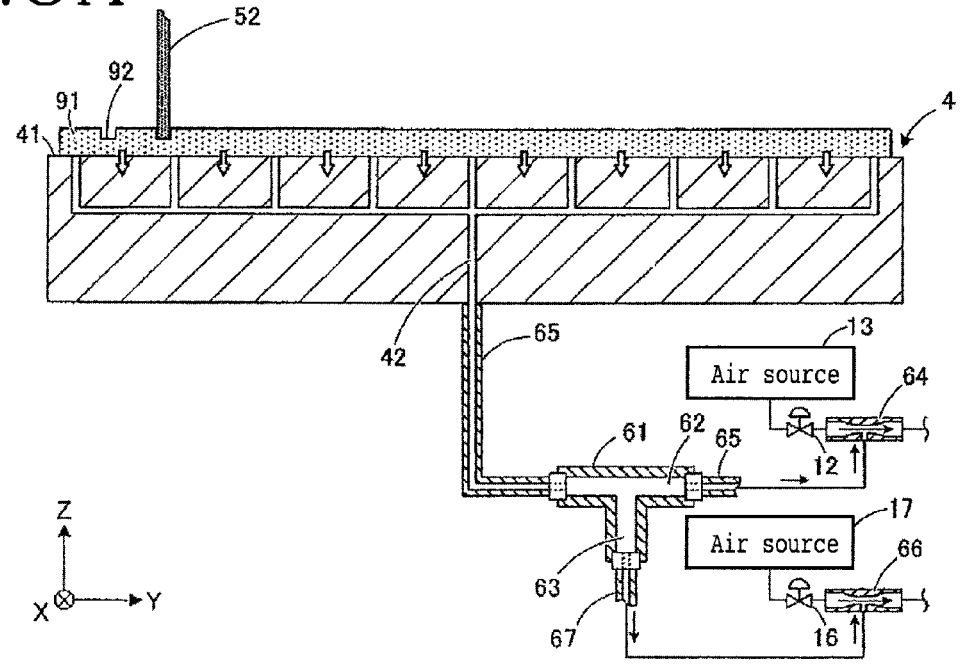
FIGS. 3A and 3B are sectional views for illustrating transition of a dressing operation conducted by the cutting apparatus according to this embodiment.
Figure 3B:
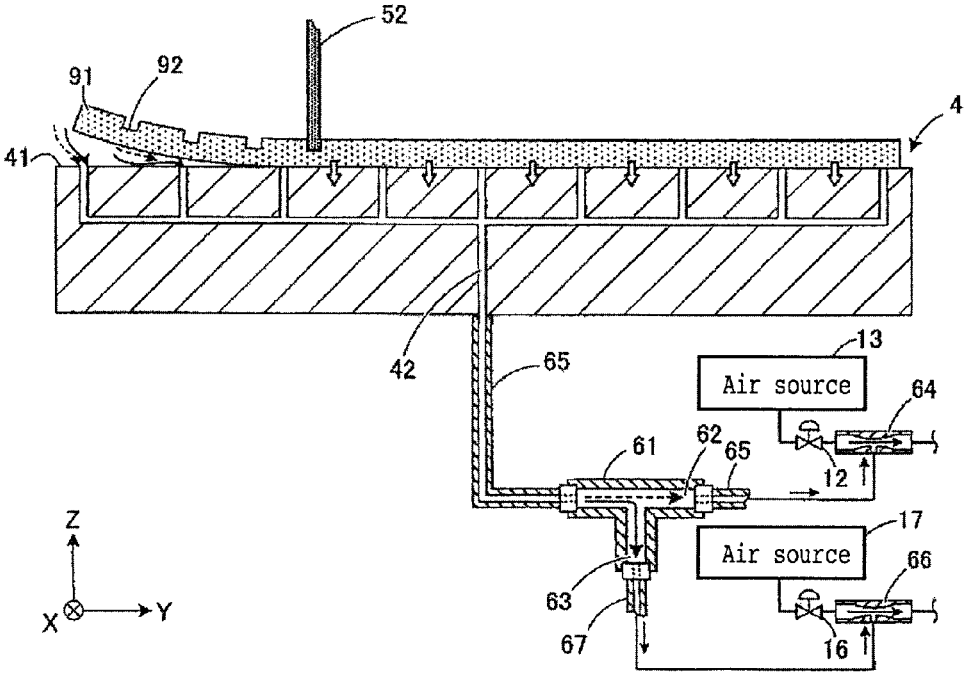
Figure 4A:
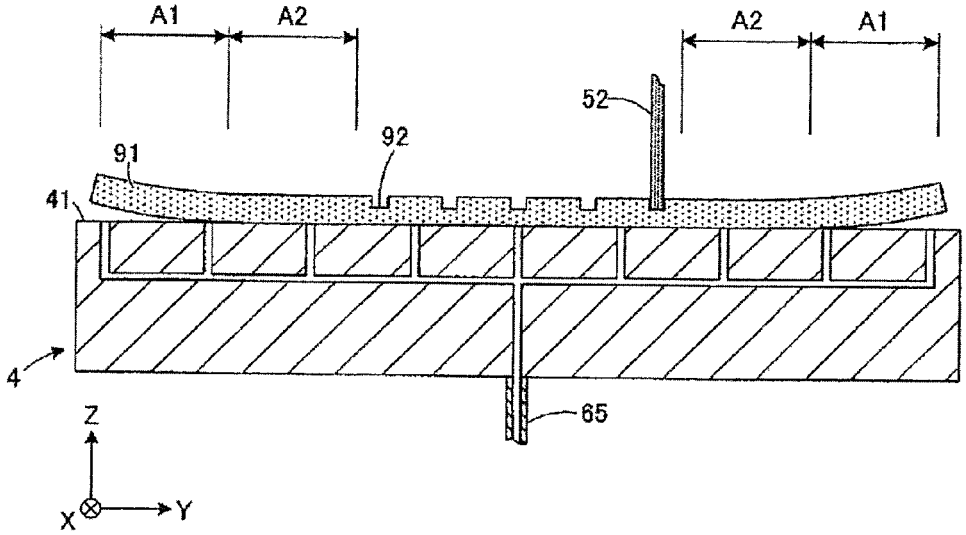
FIGS. 4A and 4B are sectional views for illustrating the order of dressing of a dresser board according to this embodiment.
Figure 4B:
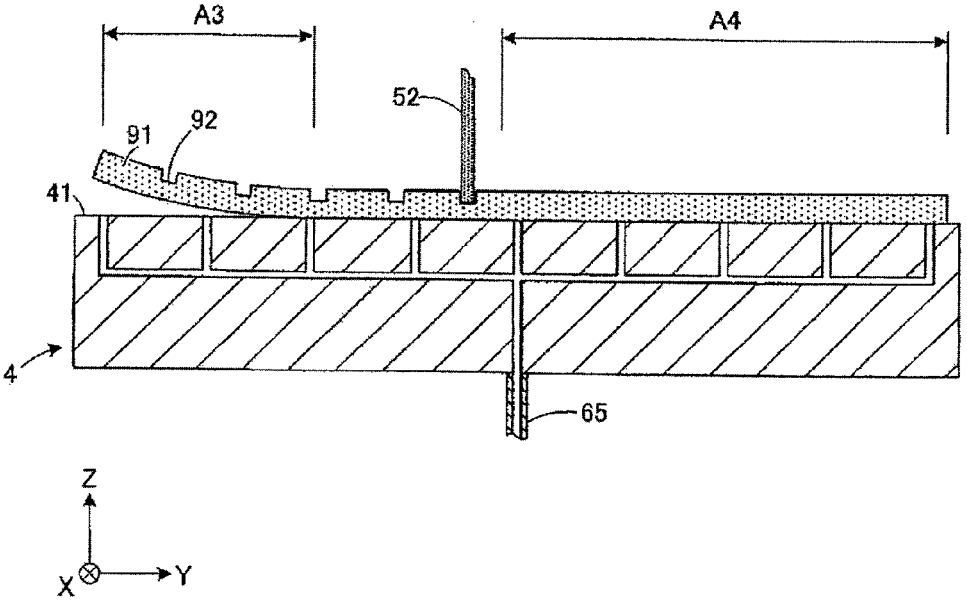

Now, dressing of the cutting blade 52 by use of the dresser board 91 will be described in detail below, referring to FIGS. 3A, 3B, 4A and 4B. FIGS. 3A and 3B illustrate transition of a dressing operation according to this embodiment. FIGS. 4A and 4B are for illustrating the order of cutting of the dresser board 91 according to this embodiment.

As shown in FIG. 3A, the valves 12 and 16 are opened to supply air from the air sources 13 and 17, and the fluids in the first and second pipings 65 and 67 are drawn in by the first and second suction sources 64 and 66. A negative pressure is generated at the suction surface 41 of the holding table 4 by the first and second suction sources 64 and 66, and the dresser board 91 on the holding table 4 is suction held onto the suction surface 41. Then, the cutting blade 52 is made to cut into the dresser board 91, starting from one end side, to form a cut groove 92. By the cutting-in of the cutting blade 52 to the dresser board 91, an outer peripheral surface of the cutting blade 52 is dressed, and the tip of the cutting blade 52 is conditioned to shape.

While the cut grooves 92 are formed in the dresser board 91 by the cutting-in of the cutting blade 52, the stress balance between the face side and the back side of the dresser board 91 starts to get upset, since the cut grooves 92 are formed only on the face side of the dresser board 91. At a beginning stage of the dressing operation, however, the rigidity of the dresser board 91 itself and the suction force at the suction surface 41 are stronger as compared to a contraction force on the face side of the dresser board 91, and, therefore, the dresser board 91 is held on the holding table 4 without warping. Accordingly, the cutting water is not drawn into the first and second suction sources 64 and 66 via the suction surface 41.

As the cutting-in of the cutting blade 52 to the dresser board 91 is repeated, the contraction force on the face side of the dresser board 91 increases, as depicted in FIG. 3B. When the contraction force on the face side of the dresser board 91 becomes greater as compared to the rigidity of the dresser board 91 itself and the suction force at the suction surface 41, the stress balance of the dresser board 91 gets upset completely, so that the dresser board 91 warps on one end side. As a result, a gap is formed between the suction surface 41 of the holding table 4 and the lower surface of the dresser board 91, and the fluid containing air indicated by broken-line arrow and the cutting water indicated by solid-line arrow is sucked into the suction surface 41 via the gap.

The fluid thus sucked in through the suction surface 41 passes through an internal passage 42 of the holding table 4, to be sent to the branched pipe 61 provided in the course of the first piping 65. Since the cross-sectional area of the flow path of the branched pipe 61 is set greater than the cross-sectional area of the flow path of the first piping 65, the flow velocity of the fluid is lowered when the fluid flows from the first piping 65 into the branched pipe 61. Then, air in the fluid flows straight in the branched pipe 61 to be sucked through the upper-side outlet 62 into the first suction source 64, whereas the cutting water in the fluid is drawn downward in the branched pipe 61 due to its own weight, to be sucked through the lower-side outlet 63 into the second suction source 66. In this way, the air and the cutting water are appropriately separated from each other in the branched pipe 61, to be each sucked through different suction passages.

As just-mentioned, the cutting water is mainly sucked into the second suction source 66, while the air is sucked into the first suction source 64, whereby the suction source offered by the first suction source 64 is restrained from being lowered. Therefore, even when the dresser board 91 is warped and air and the cutting water are sucked from the suction surface 41 of the holding table 4, the cutting water is sucked by the second suction source 66, and suction of air by the first suction source 64 can be continued. Consequently, it is unnecessary to provide suction equipment having a strong suction force such as a suction pump as the suction source, and the dresser board 91 can be suction held by use of ejectors having comparatively weak suction forces.

The same ejectors may be used as the first and second suction sources 64 and 66, or ejectors having different suction forces may be used as the first and second suction sources 64 and 66. For instance, an existing ejector may be used as the first suction source 64, and an ejector having such a suction force as to be able to suck at least the cutting water may be used as the second suction source 66. Therefore, a small-type ejector weaker than the first suction source 64 in suction force can be used as the second suction source 66. Even with such a configuration, a lowering in the suction force of the first suction source 64 can be restrained, and, accordingly, appropriate suction holding of the dresser board 91 can be continued even when the dresser board 91 is warped.

In the next place, the order of dressing of the cutting blade 52 by use of the dresser board 91 will be described. FIG. 4A illustrates a case in which the dresser board 91 is used for dressing with a good left-right balance, in the order from a center toward both sides of the dresser board 91. In this case, the cutting-in is conducted starting from the center of the dresser board 91 in such a manner that the positions of the cut grooves 92 formed in the dresser board 91 are not biased on one of the left and right sides, whereby the contraction force on the face side of the dresser board 91 is prevented from being increased locally. Since a multiplicity of cut grooves 92 are formed in the dresser board 91, slight warping occurs at both ends of the dresser board 91, and gaps are formed between the holding table 4 and the dresser board 91.

Although the dresser board 91 can be suction held onto the suction surface 41 even when the gaps are formed between the holding table 4 and the dresser board 91, those parts of the dresser board 91 at which warping has occurred cannot be used for dressing of the cutting blade 52. In other words, according to the just-mentioned order of dressing, regions A1 on both end sides of the dresser board 91 into which the cutting blade 52 does not cut cannot be used for dressing of the cutting blade 52. Therefore, the remaining regions that can be used for dressing of the cutting blade 52 are limited to regions A2 on the inner sides of the regions A1. According to such an order of dressing, the dresser board 91 cannot be utilized effectively.

FIG. 4B illustrates a case in which the plate-shaped dresser board 91 is used for dressing in the order from one end side thereof. In this case, cutting-in to the dresser board 91 is conducted starting from one end side, so that the cut grooves 92 formed in the dresser board 91 are formed concentratedly on one end side. Therefore, the stress balance of the dresser board 91 gets upset at an early stage, and the dresser board 91 warps greatly on one end side, resulting in that a gap is formed between the suction surface 41 of the holding table 4 and the lower surface of the dresser board 91. Note that the region on one end side of the dresser board 91 is already formed with the cut grooves 92, and this region is not to be used for dressing of the cutting blade 52.

As has been mentioned above, the dresser board 91 can be suction held onto the suction surface 41 even when a gap has been formed between the holding table 4 and the dresser board 91. In this instance, that part of the dresser board 91 which is warped is a part already used for dressing of the cutting blade 52, and those parts of the dresser board 91 which are yet to be used for dressing of the cutting blade 52 are not warped. In other words, according to this order of dressing, that region A3 of the dresser board 91 at which the cut grooves 92 has already been formed is warped, and the remaining region A4 not yet warped can be used for dressing of the cutting blade 52. Such an order of dressing enables effective utilization of the dresser board 91.

In the configuration adopted on the presumption that the dresser board 91 warps on the holding table 4, as in this embodiment, by dressing in the order of dressing shown in FIG. 4B rather than the order of dressing shown in FIG. 4A, it is possible to utilize the entire part of the dresser board 91 in an effective manner.

As aforementioned, in the cutting apparatus 1 according to this embodiment, the cross-sectional area of the branched pipe 61 is set larger than the cross-sectional area of the first piping 65 to generate a difference in cross-sectional area, whereby the flow velocities of air and cutting water sucked in from the suction surface 41 of the holding table 4 are lowered when the fluids flow from the first piping 65 into the branched pipe 61. Due to the lowering in the flow velocity, the air goes toward the upper-side outlet 62 of the branched pipe 61, whereas the cutting water goes down toward the lower-side outlet 63 of the branched pipe 61 by its own weight, so that the air and the cutting water are appropriately separated from each other. Since the cutting water separated in the branched pipe 61 is sucked into the second suction source 66, the suction force applied by the first suction source 64 for suction holding of the dresser board 91 onto the holding table 4 is maintained even in the case where the cutting water is sucked in from the suction surface 41 of the holding table 4 together with air. Therefore, it is unnecessary to provide large suction equipment such as a pump having a high suction capacity, and ejectors having a comparatively low suction capacity can be used as the first suction source 64 and the second suction source 66.

Note that the present invention is not limited to the above embodiment, and can be carried out with various modifications. In the above embodiment, the sizes and shapes illustrated in the attached drawings are not restrictive, and can be modified, as required, within such ranges as to produce the effect of the present invention. Other modifications are also possible, as required, without departing from the scope of the object of the present invention.

For instance, while the air sources 13 and 17 and the valves 12 and 16 are connected individually and respectively to the first and second suction sources 64 and 66 in the above embodiment, this configuration is not restrictive. For example, the first and second suction sources 64 and 66 may be provided with a common air source and a common valve. Where the first and second suction sources 64 and 66 are provided with a common air source and a common valve, the apparatus can be simplified in structure. Even with such a simplified configuration, a lowering in the suction force at the holding table 4 upon warping of the dresser board 91 on the holding table 4 can be restrained.

In addition, while the T-shaped branched pipe 61 is used in the above embodiment, the shape of the branched pipe 61 is not limited to the T shape. It is sufficient for the branched pipe 61 to be greater than the first piping 65 in cross-sectional area and to be branched in such a manner that a gas and a liquid can be separated from each other by the upper-side outlet 62 and the lower-side outlet 63. For instance, the branched pipe 61 may be formed in a laterally oriented Y shape branched to a skew upper side and a skew lower side, or may be formed in a laterally oriented T shape branched to the upper and lower sides. Besides, the branched pipe 61 may be branched into more than two directions, so long as a gas and a liquid can be separated from each other by the branched pipe 61.

Besides, while the cutting apparatus for blade dicing is shown by way of example as the cutting apparatus 1 in the above embodiment, this configuration is not limitative. The cutting apparatus 1 may be a cutting apparatus for edge trimming. In the case of a cutting apparatus for edge trimming, flat dressing for conditioning the tip of a cutting blade to a flat shape may be carried out.

In addition, while the dresser board 91 is shown by way of example as the workpiece in the above embodiment, this configuration is not restrictive. The workpiece may be any plate-shaped body that is held on the suction surface 41 of the holding table 4; for example, the workpiece may be a dummy work to be used as a sample for setting-up.

As has been described above, the present invention has such an effect that a suction force applied to a workpiece on a holding table can be maintained even when the workpiece is warped on the holding table. Particularly, the present invention is useful for a cutting apparatus wherein dressing of a cutting blade is conducted by use of a dresser board.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A cutting apparatus comprising:

a holding table having a suction surface for suction holding a plate-shaped workpiece;

cutting means for cutting the workpiece suction held by the holding table by a cutting blade and cutting water, the cutting water being supplied to the workpiece while the cutting blade cuts the workpiece; and suction force maintaining means for maintaining a suction force of the holding table for suction holding the workpiece, wherein the suction force maintaining means includes: a first piping for communication of the suction surface with a first suction source; a branched pipe by which the first piping is branched in its course to an upper-side outlet for passage toward the first suction source and a lower-side outlet for passage toward a second suction source; and a second piping for communication of the lower-side outlet with the second suction source, the first suction source and the second suction source are each an ejector, which includes: a supply port supplying air; a discharge port discharging the air; and a suction port communicating with a negative pressure generating part generating a negative pressure by causing the air to flow from the supply port to the discharge port, a cross-sectional area of the branched pipe is set greater than a cross-sectional area of the first piping, such that flow velocity of a fluid upon transfer of the fluid from the first piping into the branched pipe is lowered due to a difference in cross-sectional area, a branched shape of the branched pipe ensures that a gas sucked in from the suction surface goes toward the upper-side outlet of the branched pipe, whereas a liquid sucked in from the suction surface goes down toward the lower-side outlet of the branched pipe, whereby the gas and the liquid are separated from each other, and the separated liquid is sucked by the second suction source and discharged from the second piping, whereby the suction force applied at the suction surface by the first suction source is maintained.

* * * * *